US005136900A

United States Patent [19]

Chapin

[11] Patent Number: 5,136,900

[45] Date of Patent: Aug. 11, 1992

[54] FUSED HAND TOOL

[76] Inventor: David S. Chapin, P.O. Box 30100, Raleigh, N.C. 27622

[21] Appl. No.: 631,510

[22] Filed: Dec. 21, 1990

[51] Int. Cl.[5] ..... B25B 13/00

[52] U.S. Cl. ..... 81/52; 81/488; 81/900

[58] Field of Search ..... 81/3.8, 9.4, 52, 489, 81/488, 900

[56] References Cited

U.S. PATENT DOCUMENTS 1,902,438 3/1933 Foley ..... 81/489

*Primary Examiner*—Bruce M. Kisliuk
*Assistant Examiner*—Lawrence Cruz

[57] ABSTRACT

A hand tool includes an electrically-conductive work engaging portion. The electrically-conductive work engaging portion is connected in series with a fuse which, in turn, is connected in series with the tool handle. Small electrical charges are allowed to flow through the tool and dissipated through a charge dissipation system. If a large charge passes through the tool, the fuse blows, thus preventing injury to the tool user.

5 Claims, 1 Drawing Sheet

FUSED HAND TOOL

BACKGROUND OF THE INVENTION

The present invention relates to hand tools; more particularly, the present invention relates to fused electrical-conducting hand tools.

In many situations, it is necessary to use hand tools to work on sensitive electronic circuits. These sensitive electronic circuits can be damaged by an unwanted electrostatic discharge. Such discharges are often termed static electricity. A great deal of care and expense is currently devoted to protecting sensitive electronic circuitry from the electrostatic discharges inadvertently carried by the technicians who work on these sensitive electronic circuits. Typically, electrostatic discharges originate from the circuits themselves. Damage is done when a conductive path is formed between the circuit and a ground. In many situations, the assembler or repair technician provides the necessary electrical connection between the circuit and ground.

In many applications, the problem of electrostatic discharge is solved by placing a high-resistance tool handle between that portion of the tool which contacts the circuit and the assembler or repair technician. This high resistance tool handle prevents the flow of electricity from that portion of the tool which contacts the work piece through the worker to ground.

It is often desirable, however, that small electrical charges be conducted away from sensitive electronic circuits to assure proper operation of the circuit. In these situations, a worker safety problem is presented when the electrical charge within the circuit is not small, but is of a magnitude that may be either harmful or lethal. In these situations, any electrical conductivity of the tool handle may injure or kill the worker when the tool is used to remove an electrical charge from the circuit.

The need therefore remains in the art to provide a tool which may conduct slight electrical charges away from the work piece, but will still assure the safety of the worker in situations where the electrical charge may be harmful or lethal.

SUMMARY OF THE INVENTION

A fused hand tool which conducts slight electrical charges away from a work piece yet still assures safety of the worker includes an electrically conductive screwdriver blade or the like for contacting a work piece. In series with the electrically-conductive portion of the tool which engages the work piece is a fuse. Electrical current passes from the work piece through that portion of the tool which engages the work piece and into the fuse. The fuse is in electrical series connection with the tool grip or handle. Accordingly, electric current may pass through the fuse to the hand tool grip or handle. By placing a fuse in this electrically conductive system, no harmful or lethal electrical charges will pass from the hand tool grip into the body of the tool user. If the electrical charge would be harmful or lethal to the user, the fuse would blow, thereby preventing injury. A range of selected currents may be obtained by placing a resistor or other electrical component in series with the fuse. The hand tool may be constructed so that the fuse, the resistor and other components are replaceable.

BRIEF DESCRIPTION OF DRAWINGS

A better understanding of the fused hand tool of the present invention may be had by reference to the drawings wherein.

BRIEF DESCRIPTION OF THE EMBODIMENTS

Figure 1:
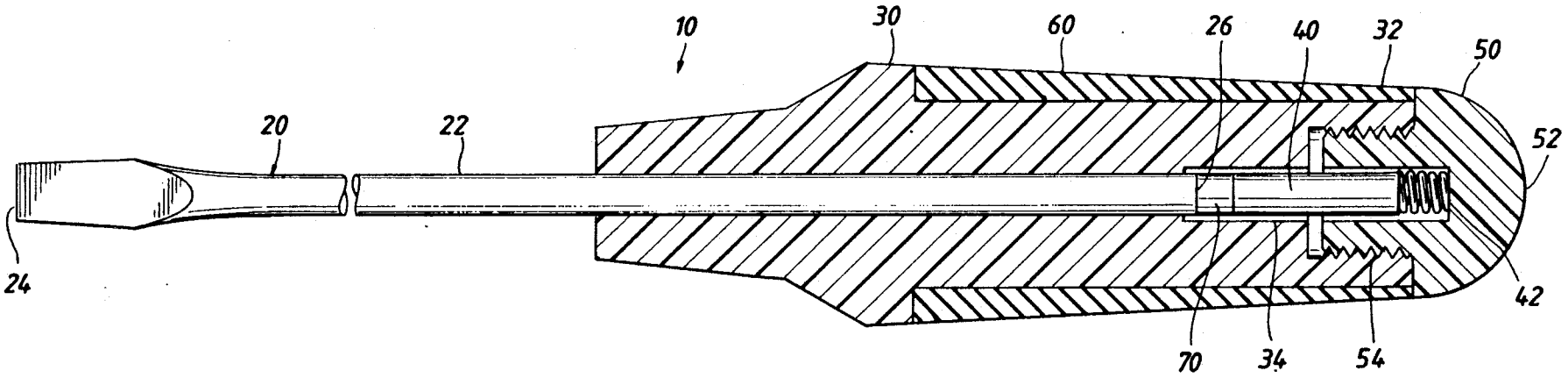
FIG. 1 is a cross-section of a handle of the fused handle hand tool of the present invention.

A better understanding of the fused hand tool system 10 of the present invention may be had by reference to the following description and to the figures. A screwdriver 20 is used to illustrate the principles of the present invention; however, those of ordinary skill in the art will understand that the improvements embodied in the present invention as applied to the screwdriver 20 may also be used with pliers, probes, pries, or similar hand tools (not shown) wherein a portion of the tool comes in contact with a work piece having an electrical charge.

The electrical pathway of the tool 10 of the present invention begins at the end 24 of the screwdriver shaft 22 that is anchored in an insulating or non-conducting (typically hard plastic) handle 30. The shaft 22 protrudes from the non-conducting handle 30; however, in the present invention, the base 26 of the shaft 22 is in contact with a fuse 40. The fuse 40 is held against the base 26 of the blade 20 by a removable cap 50 at the end 32 of the screwdriver handle 30. The removable cap 50 includes an electrical contact 52 and is electrically conductive. The removable cap 50 also contacts an external sleeve 60 formed around the outside of the screwdriver handle 30. The external sleeve 60 may be either soft or hard, and it also is electrically conductive. The user grabs the handle 30 and, when doing so, places himself in the flow of electricity from the work piece down the shaft 22 of the tool to the fuse 40 and out the sleeve 60 surrounding the handle 30.

If a harmful, or possibly lethal, current is to be conducted away from the work piece, the fuse 40 would blow, thus severing the connection between the conductive ca 50 and sleeve 60 and the tool shaft 22, consequently preventing any harm to the worker.

In order that the fuse 40 may be held in position and be easily replaced, a compartment 34 is formed within the tool handle 30 for containing the fuse 40. The fuse 40 fits within the compartment and is held in position by a spring 42. The spring member 42 is in physical contact with the removable cap 50. In the preferred embodiment, the removable end cap 50 engages the handle 30 by use of a threadable connection 54. It will be understood by those of ordinary skill in the art that numerous other types of connections other than the threaded connection may be used without departing from the scope of the present invention.

There also may be placed in series between the tool shaft 22 and the fuse 40 a variable resistor 70. The variable resistor 70 may be changed to make the screwdriver 20 conductive, static dissipative or anti-static.

OPERATION

Figure 2:
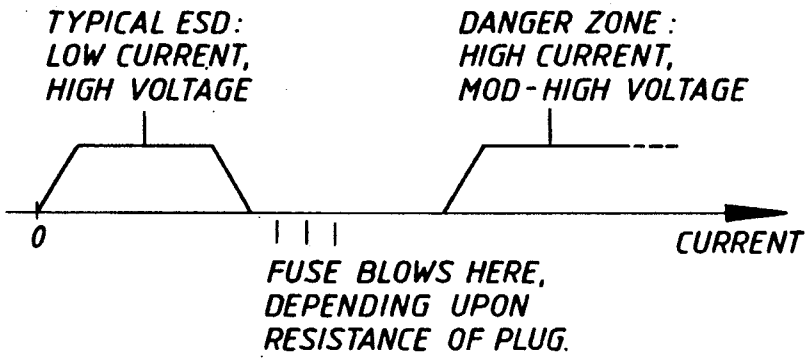
FIG. 2 is a graph depicting the current and voltages which may be transmitted by the fused hand tool of the present invention.

The operation of the tool system 10 of the present invention may be best understood by reference to FIG. 2 wherein it may be seen that various currents may be conducted away from the work piece. At the left side of the graph is low current which may or may not have a high voltage. Typically, such currents may be conducted away from the work piece without providing danger to the worker using a tool. This is particularly so if the worker is standing on an anti-static mat or similar system.

At the opposite end of the graph is a danger zone wherein the current conducted away from the work piece is high, and the voltage may be high. In this zone, the worker would feel discomfort or may even be subjected to a lethal dose of electricity.

In between the left end and right end of the graph is the area in which the fuse would blow. The exact current at which the fuse would blow is dependent upon the size of the resistor 70 and the electrical characteristics of the particular fuse used in the tool handle 30.

There is thereby provided by the fused hand tool system 10 of the present invention a means for providing an electrically-conductive tool 20 that prevents worker discomfort and provides for worker safety.

Those of ordinary skill in the art will understand that additional embodiments of the fused power tool system 10 of the present invention may be made once the foregoing disclosure has been understood. Such embodiments shall be included within the scope of the appended claims.

I claim:

1. A hand tool comprising:

means for engaging a workpiece;

an insulating handle for mounting said means for engaging a workpiece;

a fuse in contact with said means for engaging a workpiece;

means for gripping said insulating handle in electrical contact with said fuse member;

whereby low electrical charges characterized by low current and high voltages may be conducted away from said workpiece through said means for engaging the workpiece thence through said fuse member and thence through said means for gripping said insulating handle, but the flow of high electrical charges characterized by high current and moderate to high voltages away from said workpiece will be prevented by the blowing of said fuse.

2. The hand tool as defined in claim 1 further including a variable resistance member in series electrical connection with said fuse member.

3. The hand tool as defined in claim 2 further including a spring member for positioning said fuse member.

4. The hand tool as defined in claim 3 further including a removable end cap for replacement of said fuse member.

5. A hand tool comprising:

electrically-conductive means for engaging a workpiece;

a fuse in electrical contact with said electrically conductive means for engaging the workpiece;

a variable resistance member placed in electrical series connection between said electrically conductive means for engaging a workpiece in said fuse member;

means for gripping the hand tool in electrical contact with said fuse;

a spring member for positioning said fuse within said means for gripping the hand tool;

a removable end cap constructed and arranged for the placement of said fuse within said means for gripping the hand tool;

whereby low electrical charges characterized by low current and high voltages may be conducted away from said workpiece through said means for engaging the workpiece thence through said fuse and thence through said means for gripping the hand tool, but the flow of high electrical charges characterized by high current and moderate to high voltages away from said workpiece will be prevented by said fuse.

* * * * *